US010285445B2

(12) United States Patent
Metz et al.

(10) Patent No.: US 10,285,445 B2
(45) Date of Patent: May 14, 2019

(54) PERSONAL ELECTRONIC DELIVERY SYSTEM, ATOMIZER ASSEMBLY, USE THEREOF AND CORRESPONDING PRODUCTION METHOD

(71) Applicant: UTVG GLOBAL IP B.V., Montfoort (NL)

(72) Inventors: Sybrandus Jacob Metz, Heerenveen (NL); Gerhard Hendrik Mulder, Weesp (NL); Johannes Kuipers, Leeuwarden (NL); Hans Hendrik Wolters, Leeuwarden (NL)

(73) Assignee: UTVG GLOBAL IP B.V., Montfoort (NL)

( * ) Notice: Subject to any disclaimer, the term of this patent is extended or adjusted under 35 U.S.C. 154(b) by 0 days.

(21) Appl. No.: 15/541,321

(22) PCT Filed: Dec. 30, 2015

(86) PCT No.: PCT/NL2015/050920
§ 371 (c)(1),
(2) Date: Jun. 30, 2017

(87) PCT Pub. No.: WO2016/108694
PCT Pub. Date: Jul. 7, 2016

(65) Prior Publication Data

US 2017/0347714 A1 Dec. 7, 2017

Related U.S. Application Data

(60) Provisional application No. 62/102,862, filed on Jan. 13, 2015.

(30) Foreign Application Priority Data

Dec. 31, 2014 (NL) ..... 2014078
Jan. 22, 2015 (NL) ..... 2014176
(Continued)

(51) Int. Cl.
*A24F 13/00* (2006.01)
*A24F 47/00* (2006.01)
(Continued)

(52) U.S. Cl.
CPC ..... *A24F 47/008* (2013.01); *H05B 3/16* (2013.01); *H05B 3/18* (2013.01); *H05B 3/265* (2013.01);
(Continued)

(58) Field of Classification Search
CPC ..... A24F 47/008
(Continued)

(56) References Cited

U.S. PATENT DOCUMENTS 5,498,855 A 3/1996 Deevi et al.
5,530,225 A 6/1996 Hajaligol
(Continued)

FOREIGN PATENT DOCUMENTS

EP 2807935 A1 12/2014
WO 2013083634 A1 6/2013
(Continued)

OTHER PUBLICATIONS

International Search Report and Written Opinion dated May 30, 2016 in International Patent Application No. PCT/NL2015/050920, 10 pages.

*Primary Examiner* — Phuong K Dinh
(74) *Attorney, Agent, or Firm* — Shook, Hardy & Bacon L.L.P.

(57) ABSTRACT

A personal electronic delivery system includes a housing having a first end with an inlet and a second end with an outlet a fluid path substantially extending between the inlet and the outlet, a buffer for holding a delivery fluid, connecting means configured to transfer delivery fluid to the fluid path, a heater that is provided in, at or close to the fluid path
(Continued)

configured for heating the delivery fluid such that at least a part of the delivery fluid atomizes and/or vaporizes in the fluid path, and an energy source configured for providing energy to the heater. The buffer substantially surrounds the heater and includes openings in a groove for transferring delivery fluid to the heater.

3 Claims, 14 Drawing Sheets

(30) Foreign Application Priority Data

| | | |
|---|---|---|
| Mar. 16, 2015 | (NL) | 2014461 |
| Sep. 11, 2015 | (DE) | 20 2015 006 397 U |
| Nov. 10, 2015 | (NL) | 2015766 |
| Nov. 18, 2015 | (CN) | 2015 2 0921474 U |
| Dec. 23, 2015 | (DE) | 20 2015 008 791 U |

(51) Int. Cl.
*H05B 3/26* (2006.01)
*H05B 3/16* (2006.01)
*H05B 3/18* (2006.01)
*H05B 3/48* (2006.01)

(52) U.S. Cl.
CPC ..... *H05B 3/48* (2013.01); *H05B 2203/002* (2013.01); *H05B 2203/022* (2013.01)

(58) Field of Classification Search
USPC ..... 131/328–329
See application file for complete search history.

(56) References Cited

U.S. PATENT DOCUMENTS

| | | | | |
|---|---|---|---|---|
| 2014/0060554 | A1* | 3/2014 | Collett | H05B 3/265 131/328 |
| 2015/0090280 | A1* | 4/2015 | Chen | A24F 47/008 131/329 |

FOREIGN PATENT DOCUMENTS

| | | | |
|---|---|---|---|
| WO | 2014147114 | A1 | 9/2014 |
| WO | 2016108694 | A1 | 7/2016 |

* cited by examiner

PERSONAL ELECTRONIC DELIVERY SYSTEM, ATOMIZER ASSEMBLY, USE THEREOF AND CORRESPONDING PRODUCTION METHOD

CROSS-REFERENCE TO RELATED APPLICATIONS

This application claims priority under 35 U.S.C. § 365 to PCT/NL2015/050920, filed on Dec. 30, 2015, entitled "PERSONAL ELECTRONIC DELIVERY SYSTEM, ATOMIZER ASSEMBLY, USE THEREOF AND CORRESPONDING PRODUCTION METHOD," Netherlands Application No. 2014078, filed Dec. 31, 2014, U.S. Application No. 62/102,862, filed Jan. 13, 2015, Netherlands Application No. 2014176, filed Jan. 22, 2015, Netherlands Application No. 2014461, filed Mar. 16, 2015, German Application No. 20215006397.7, filed Sep. 11, 2015, Netherlands Application No. 2015766, filed Nov. 10, 2015, Chinese Application No. 201520921474, filed Nov. 18, 2015, and German Application No. 202015008791.4, filed Dec. 23, 2015, the entirety of the aforementioned applications are incorporated by reference herein.

The present invention relates to a personal electronic delivery system capable of delivering a delivery fluid to a person. Such system includes so-called E-cigarettes.

Delivery systems, such as E-cigarettes, are known and comprise an inhaling device with an inlet and an outlet that is shaped as a mouth piece. E-cigarettes further comprise a battery and a heater that is provided with energy from the battery. The heater is winded around a so-called wicking material that acts as a buffer, wherein the heater is switched on and off with a flow detector located in the inlet, for example. A buffer comprises the delivery fluid, such as a so-called E-liquid, usually being a mixture of propylene glycol, glycerine, nicotine, and flavourings. The heater vaporises and/or atomises the E-liquid to enable inhaling of the liquid.

A problem with conventional E-cigarettes is the insufficient control of heater temperature when the heater is in use. This results in vaporizing and/or atomising of the E-liquid with a relatively large temperature variation such that components in the E-liquid are not only heated, and are burnt in stead. This provides undesirable components in the inhaled fluid that could pose a problem in relation to a person's health. Furthermore, most conventional E-cigarettes have a buffer embodied as a type of cloth that comprises the E-liquid. Also burning this buffer material may result in undesirable components being inhaled by the person using the E-cigarette. Furthermore, using conventional E-cigarettes may result in release of heavy metals.

The present invention has for its object to provide a personal electronic delivery system, specifically including E-cigarettes, that enable a more controllable atomisation and/or vaporization thereby reducing and/or preventing health problems.

This object is achieved with the personal electronic delivery system according to the present invention, the system comprising:

- a housing having a first end with an inlet and a second end with an outlet;
- a fluid path substantially extending between the inlet and the outlet;
- a buffer for holding a delivery fluid, and connecting means configured to transfer delivery fluid to the fluid path; and

- a heater that is provided in, at or close to the fluid path configured for heating the delivery fluid such that at least a part of the delivery fluid atomises and/or vaporizes in the fluid path, and an energy source configured for providing energy to the heater, wherein the heater comprises a metal wire as conductor that is provided with a porous ceramic layer that is configured to control the atomizing and/or vaporization, and wherein the buffer substantially surrounds the heater, wherein the buffer is provided with openings configured for transferring delivery fluid to the heater.

Providing a fluid path from the inlet to the outlet, preferably embodied as a mouth piece, enables inhaling at the outlet to draw/suck in ambient air, for example. This provides a personal electronic delivery system, such as E-cigarettes that also include so-called E-cigars. The heater that is included in the system atomises and/or vaporizes the delivery fluid when the heater is switched on. Switching on the heater can be achieved with the use of a flow controller close to the inlet, for example. Energy is provided to the heater, by an energy source, for example a (rechargeable) battery. The delivery fluid can relate to a mixture of liquids and/or solids, including so-called E-liquids that may comprise a mixture of propylene glycol, glycerine, nicotine and flavourings. It will be understood that other ingredients can also be applied and/or nicotine can be omitted from the mixture.

The heater element comprises a conductor that can be shaped as a plate, wire, foil, tube, foam, rod or any other suitable shape, preferably of a so-called resistance heating material that can be heated by applying an electric current to the conductor of the heater element. The conductor can be of a suitable material, including aluminium, FeAl, NiC, FeCrAl (Kanthal), titanium, and their alloys. Especially the use of the metal titanium provides good results.

The ceramic layer that is provided on or adjacent the conductor enables effective control of heater temperature thereby preventing burning of components in the delivery fluid and/or other elements of the system, such as buffer material. This improves the quality of the inhaled fluid by preventing undesirable components being present therein.

As a further effect the ceramic layer provides structure and stability to the conductor thereby increasing the strength and stability of the heater as a whole. This is especially relevant in case the system is applied as an E-cigarette. Such E-cigarette is subjected to many movements, vibrations and/or other impacts. For example, the increased stability prevents malfunctioning and/or prevents contact of the heater with other components of the system, including buffer material such as a cloth that is drenched in E-liquid. This prevents undesired burning of components. Furthermore, the ceramic layer prevents the release of heavy metals.

Also the ceramic layer enables adsorption and/or absorption of the E-liquid in the pores of the ceramic layer.

It may seem counterintuitive to use a ceramic for the heater, as ceramics are known to be thermal insulators, or at least poor thermal conductors. Surprisingly however, the ceramic layer does have a positive effect on the heating of the delivery fluid. The inventors found that the ceramic layer is able to even out spikes in the temperature of the conductor, thereby preventing burning of the delivery fluid. Importantly, the pores of the ceramic layer allow the delivery fluid to come close to the electrical conductor, i.e. the pores can be said to reduce the effective thickness of the layer from a thermal point of view. Therefore, the pores mitigate the negative effect on the heat transfer of the normally poorly conducting ceramic. Moreover, the pores increase the contact surface between the ceramic and the delivery fluid, thereby further enhancing the heat transfer from the heater to the fluid. Therefore, the porous ceramic layer achieves an effective heating of the delivery fluid for vaporizing and/or atomising thereof, even though the ceramic material in itself is a poor thermal conductor.

The buffer may comprise a container, i.e. a holder, and/or a buffer material, such as a cloth or wicking material.

The connecting means are configured to transfer delivery fluid to the fluid path, and are thus means for transferring delivering fluid from the buffer to the fluid path. The connecting means may also be referred to as transfer means or transport means. For example, the connecting means may comprise a wicking material. In addition or alternatively, in case the buffer is provided as a container, the connecting means may comprise openings formed in the walls of said buffer, to enable fluid to pass from the buffer through the openings to the fluid path.

In a presently preferred embodiment according to the invention the ceramic layer has a thickness in the range of 5-300 μm, preferably 10-200 μm, more preferably 15-150 μm and most preferably a thickness is about 100 μm.

By providing the ceramic layer with a sufficient thickness the stability and strength of the heater is improved. Furthermore, the insulation is increased, enabling control of heat transfer and/or heat production. The thickness of the ceramic layer can be adapted to the type of E-liquid and/or the specific system and/or the desired characteristics. This flexibility during production provides a further advantage of the system according to the invention.

Preferably, the ceramic layer is provided on or at the conductor with plasma electrolytic oxidation. The heater element is preferably made from a titanium material, or other suitable material, on which a porous metal oxide layer, such as titanium oxide, is grown with plasma electrolytic oxidation. Plasma electrolytic oxidation enables that a relatively thick titanium oxide layer is grown from the titanium (>130 μm) by oxidizing (part of) the titanium to titanium oxide. Especially the use of titanium provides good results. The resulting layer is a porous, flexible and elastic titanium oxide ceramic. Plasma electrolytic oxidation (>350-550 V) requires much higher voltage compared to standard anodizing (15-21 V). At this high voltage, micro discharge arcs appear on the surface of the titanium, or other material, and cause the growth of the thick (titanium) oxide layer. Other metals, such as aluminium or nichrome, may also be used for the heater element of the system according to the present invention. For example, results have shown that a ceramic layer can be achieved on an aluminium foil of about 13 μm thickness, resulting in a flexible and elastic ceramic layer. One of the advantageous effects of using plasma electrolytic oxidation to provide the ceramic layer is that due of the growth of the layer from the metal during oxidation the adherence of the ceramic layer to the metal is excellent.

In a presently preferred embodiment the structure of the heating element comprises a thin wire of titanium, aluminium, or any other valve metal, such as magnesium, zirconium, zinc, niobium, vanadium, hafnium, tantalum, molybdenum, tungsten, antimony, bismuth, or an alloy of one or more of the preceding metals. Such valve metal is capable of forming an oxide layer which forms a protective layer on its surface and then stops it to oxidize further. In a presently preferred embodiment titanium is used for the heating element considering its relatively high resistance achieving a relatively fast heating process. The wire is coated on the other side through plasma electrolytic oxidation. Plasma electrolytic oxidation is done by placing the titanium wire in an electrolyte. For example, the electrolyte comprises 15 g/l $(NaPO_3)_6$ and 8 g/l $Na_2SiO_3.5H_2O$. The electrolyte is maintained at a temperature of 25° C. through cooling. The wire is used as an anode and placed in a container containing the electrolyte. Around the wire a stainless steel cathode is positioned. A current density is maintained between the wire and cathode of about 0.15 $A/cm^2$. The current is applied in a pulsed mode of about 1000 Hz. The potential increases rapidly to about 500 Volt between the wire and the cathode. This creates a plasma electrolytic oxidation process on the anode wire and creates a ceramic layer.

As the wire is small sized (100 micron) it has a relative high electrical resistance 61 Ohm/m. By applying a current to the wire during use of the personal electronic delivery system, the wire heats up. It will be understood that process parameters may depend on the structure of the heating element and/or the dimensions thereof.

In an alternative embodiment a plate of metal, for example aluminium, titanium or other valve metal, is coated on at least one side with a ceramic layer using plasma electrolytic oxidation, for example. Due to metal plate resistance its temperature increases when a current is applied. Also, a structure can be etched into the metal providing metal strips of metal having a relatively high resistance. The etching can be performed using electrochemical machining, for example.

Alternative manufacturing methods for the heater element include sintering or spark plasma sintering, oxidation of the surface layer of the metal by heating in oxygen rich environment, anodizing, and plasma spraying. Also, it would be possible to deposit an aluminium, or other material, coating on the conductor of the heater element, for example with arc spraying, and to oxidize the deposited material to an oxide with plasma electrolytic oxidation.

Further alternative manufacturing methods for the heater element include chemical vapour deposition, physical vapour deposition, electrochemical machining (ECM), chemical and/or electrochemical oxidation, thermo-treatment involving high temperatures of above 200° C. or 300° C. and exposure to oxygen, and coating or dipping involving a slurry with titanium particles, for example, followed by a sintering step. Also, the core of the heater element can be provided with a layer of titanium or aluminium or similar material (plating) where after one or more of the foregoing manufacturing methods is performed.

In a presently preferred embodiment according to the present invention, the heater comprises a spiralled metal wire as the conductor with the wire being provided with the ceramic layer.

Providing the heater with a spiralled metal wire an effective atomisation and/or vaporisation of delivery fluid can be achieved. The spiralled metal wire is preferably provided in the fluid path. This achieves an effective heating of the E-fluid.

Alternative configurations for the heater in a wire configuration include a straight wire, single or multiple layer solenoid wire, toroid single or multiple layer, and flat coil. Alternative configurations for the heater in a foil or plate configuration include a flat, round, rectangular shape, spiral wound, and folded configuration. Further alternative configuration for the heater in a tube configuration include a metallic tube with coated porous ceramic layer and optionally provided with a (static) mixing structure or helix structure, tube shape of foil/plate, and spiral wound foil/plate. An even further alternative configuration of the heater in a foam configuration includes a sponge structure.

In an embodiment according to the present invention the central axis, or longitudinal direction of the spiralled metal wire, is positioned substantially transversally to the main fluid flow direction in the fluid path.

In a presently preferred embodiment according to the invention the spiralled heater has a central axis that is provided substantially in a longitudinal direction of the fluid path. Even more preferably, the fluid path is designed such that the fluid to be inhaled passes through the spiralled wire in the longitudinal direction. This enhances the atomisation and/or vaporisation, thereby improving control of these processes and/or reducing the amount of the required energy to perform these processes. This improves the lifetime of the system according to the invention.

In a presently preferred embodiment the ceramic layer is provided with porosity such that the delivery fluid is transferred from the buffer to the vicinity of the conductor.

By providing a porous ceramic layer it is possible to configure the ceramic layer such that the delivery fluid is transferred through or along the ceramic layer enabling delivery fluid to transfer from a buffer to the conductor. This prevents the need to provide a separate buffer such as a buffer cloth.

Preferably, the ceramic layer has a porosity in the range of 10-80%, preferably 15-50%, more preferably 20-30% and most preferably the porosity is about 25%. It was shown that especially the porosity in a range of 20-30% provides an optimum in the performance of specifically the ceramic layer and the heater as a whole. Furthermore, it is shown that using plasma electrolytic oxidation to provide the ceramic layer is beneficial in that it enables control of the porosity of the produced layer.

According to the present invention the buffer substantially surrounds the heater, wherein the buffer is provided with openings configured for transferring delivery fluid to the heater.

The buffer may be formed by a tubular container, wherein openings are provided in the wall of said container for transferring delivery fluid from the buffer to the fluid path, and to the heater. Preferably, the openings are provided adjacent the heater. This improves possibilities to provide a wickless system.

Preferably, the e-liquid/delivery fluid is transported from the buffer to the heater by a venturi effect when a user inhales and an air flow is started. This obviates the need for a wig or similar element.

Providing the buffer substantially around the heater enables fluid to be delivered through a number of small openings in the inner surface (area) of the buffer compartment which is filled with liquid through capillary action of the e-liquid/delivery fluid. The heating element with porous ceramic layer is positioned on the other side of the opening(s). Liquid is transferred to the heating element by capillary action. If the heating element is heated by an electric current, liquid is evaporated from the ceramic layer and the liquid in the opening(s) is heated by the element. Due to the higher temperature caused by the heating elements the viscosity decreases and the liquid is adsorbed on the ceramic layer through the openings or holes. The holes are preferably made in a metal tube since this withstands the heat. This provides a robust supply of delivery fluid to the heater.

For example, the openings or holes may be formed by laser cutting, drilling, machining, electrochemical machining, punchen, stamping, pressing, die cutting, puncturing or otherwise. Moreover, the buffer may be produced including the opening by moulding.

The heater element enables an improved temperature control as compared to conventional systems. This provides an optimal temperature thereby maintaining viscosity of the e-liquid/delivery fluid around its desired value. This improves the evaporation process.

In a presently preferred embodiment according to the invention the system further comprises a power and/or current increasing circuit configured for providing a power increase when the heater is switched on.

By providing the power and/or current increasing circuit the power can temporarily be increased when switching on the heater. Such circuit may comprise one or more capacitors and/or one or more coils. The circuit enhances the effect of the heater and/or reduces the requirements for the power supply.

In a presently preferred embodiment a capacitor, preferably a so-called super-capacitor, is included in a circuit that provides a peak current, preferably when a user of an E-cigarette starts to inhale. When activating the heater to atomize and/or vaporize the fluid, the heater temperature has to be increased. By providing a (super) capacitor this temperature increase can be performed faster and almost instantaneously. This enables the device, for example an E-cigarette, to almost directly provide a fluid at its outlet comprising atomized and/or vaporized delivery fluid. The current increase/peak when activating the heater element leads to heat development in het heater element that is used to atomize and/or vaporize the delivery fluid. The heater element according to the invention comprises a porous ceramic layer that is preferably capable of absorbing and/or adsorbing delivery fluid. This enables the heater element to start directly with the atomizing and/or vaporizing. As a further advantageous effect the battery is not required to provide the peak current when activating the heater element. This enables providing a smaller battery, thereby enabling dimensioning an E-cigarette in conformity with the size of a conventional cigarette, for example. Furthermore, with the additional circuit comprising a (super) capacitor the battery is not subjected to peak demands and can, therefore, be operated at a more constant level. This improves the lifetime of the battery. The capacitor can be charged by the battery after the heater element is de-activated. In an advantageous embodiment the heater element is made from a titanium material that has a relatively low resistance at low temperature (e.g. 20° C.) and a high resistance at a higher temperature. This enables providing a higher current to the heater element when activating the heater element, while after the heater element reached its optimal operating temperature the applied current is lower. In fact, the resistance of titanium at the vaporisation and/or atomisation temperature is optimal for the battery. With the use of the (super) capacitor the battery is no longer limiting the (minimum) resistance of the heater element, thereby enabling an improved design of the heater element and the device comprising this heater element. Especially the combination of a super capacitor with titanium wire conductor appears beneficial.

In one of the presently preferred embodiments according to the invention the super capacitor is connected to a charge-connector configured for connecting the super capacitor to an external power source for charging the super capacitor. This enables external charging of the super capacitor without the need for the battery to supply the power for charging the super capacitor. In a further preferred embodiment system does not include a battery. In this embodiment the super capacitor supplies all required energy and is charged from an external power supply. Preferably, the super capacitor has a capacity of 12 Farad, or more. This reduces the number of components of the system, reduces system weight, and immediately provides energy for vaporization/atomization. Optionally, the system is charged in the cigarette box, for example using a rechargeable battery.

In an embodiment of the invention, the system may be provided with a solar panel on its outer surface, e.g. the outer surface of the housing. The solar panel may be configured for charging the battery or capacitor.

In a presently preferred embodiment the conductor of the heater element is made of NiCr and preferably of Titanium. The resistance of Titanium increases more rapidly with temperature as compared to NiCr.

In a further preferred embodiment according to the invention the housing comprises a tube having an inner surface that is at least partly provided with a ceramic layer, and wherein the heater at least partly extends into the tube.

The tube enables additional control of heater conditions such that in use less temperature fluctuations occur. This improves the inhalation process.

The present application further relates to and atomizer assembly for a personal electronic delivery system, comprising:

- a housing having a first end with an inlet and a second end with an outlet;
- a fluid path substantially extending between the inlet and the outlet;
- a buffer for holding a delivery fluid, and connecting means configured to transfer delivery fluid to the fluid path; and
- a heater that is provided in, at or close to the fluid path configured for heating the delivery fluid such that at least a part of the delivery fluid atomises and/or vaporises in the fluid path,
  wherein the heater comprises a conductor and a porous ceramic layer that is configured to control the atomizing and/or vaporization.

Personal electronic delivery systems in general comprise a holder, also known as battery assembly, and an atomizer assembly connectable to said holder. The atomizer assembly is often disposable and preloaded with delivery fluid in the buffer. According to embodiments of the invention, an atomizer assembly includes a heater comprising a conductor and a porous ceramic layer, wherein preferably the ceramic layer is provided on or at the conductor, e.g. by means of plasma electrolytic oxidation as described herein.

The same advantages and effects apply to the atomizer assembly as described above with respect to the personal delivery system according to the invention. Moreover, the heater and/or buffer of the atomizing assembly may be embodied as described herein with respect to the personal delivery system. For example, the features as described in one or more of the claims 2-11 are also optional features for the atomizing assembly.

The present invention also relates to the use of a personal electronic delivery system as described herein, for delivering the delivery fluid to a person, comprising the steps of:

- providing said personal electronic delivery system,
- inhaling at the second end of the housing to provide a subnormal pressure in the fluid path such that the ambient air is sucked into the inlet; and
- atomising and/or vaporising at least a part of the delivery fluid with the heater and delivering at the outlet.

Said use provides the same effects and advantages as described for the system. The use provides effective means to deliver a delivery fluid to a person, for example to provide the feel of tobacco smoking, without increasing health problems by burning components of the delivery fluid and/or system.

Preferably, in use, the heater reaches a temperature in the range of 50-300° C., preferably 100-200° C., and more preferably 120-180° C. As shown, at these temperatures a good atomisation and/or vaporisation of the delivery fluid can be achieved.

The invention further relates to a method for producing a personal electronic delivery system, comprising:

- providing a housing having a first end with an inlet and a second end with an outlet, wherein a fluid path substantially extends between the inlet and the outlet;
- providing a buffer for holding a delivery fluid, and providing connecting means configured to transfer delivery fluid to the fluid path;
- providing a heater in, at or close to the fluid path for heating the delivery fluid such that at least a part of the delivery fluid atomises and/or vaporises in the fluid path, and an energy source configured for providing energy to the heater,
  wherein providing the heater comprises providing a conductor and a porous ceramic layer that is configured to control the atomizing and/or vaporization.

The same effects and advantages apply to the method as described above with respect to the personal electronic delivery system, the use thereof and the atomizer assembly. Moreover, the production method may include the steps as described herein with respect to the personal delivery system and/or the atomizing assembly.

Preferably, the production method further comprises providing an energy source configured for providing energy to the heater.

Preferably, the heater is provided as a conductor with a ceramic layer. More preferably, the ceramic layer is provided using plasma electrolytic oxidation. Plasma electrolytic oxidation is preferably used as it enables control of the porosity and/or thickness of the ceramic layer.

Preferably, the ceramic layer produced has a thickness in the range of 5-300 μm, preferably 10-200 μm, more preferably 50-150 μm, and most preferably the thickness is about 100 μm.

In an example of a plasma electrolytic oxidation process, the thickness of the ceramic layer is controlled by controlling the voltage, duration of the process, current density, electrolyte concentration and composition.

Preferably, the conductor of the heater is provided as a valve metal, preferably titanium.

In an embodiment, the conductor is provided as a spiralled metal wire, wherein the wire is provided with the ceramic layer. The spiralled heater may be provided with its central axis substantially in the longitudinal direction of the fluid path.

Preferably, the ceramic layer is provided with a porosity such that the delivery fluid is transferred from the buffer to the vicinity of the conductor by the ceramic layer. In an example of a plasma electrolytic oxidation process, the porosity of the ceramic layer is controlled by controlling the voltage and the duration of the process. Preferably, the ceramic layer is provided with a porosity in the range of 10-80%, preferably 15-50%, more preferably 20-30%, and most preferably the porosity is about 25%.

In an embodiment, the buffer is provided substantially surrounding the heater, wherein the buffer is provided with openings configured for transferring delivery fluid to the heater. Preferably, the openings are configured to enable a venturi effect for transferring delivery fluid to the heater. Optionally, the openings may be provided in a groove.

The production method may optionally comprise providing a power and/or current increasing circuit configured for providing a power and/or current increase when the heater is switched on. Preferably, the circuit comprises a super-capacitor. Preferably, the super-capacitor is connected to a charge-connector configured for connecting the super-capacitor to an external power source for charging.

Further advantages, features and details of the invention are elucidated on the basis of preferred embodiments thereof wherein reference is made to the accompanying drawings, in which:

FIG. 1 shows an E-cigarette according to the invention;

FIG. 2 A-V shows configurations of the heater element according to the invention;

FIG. 3 A-B shows a setup of a plasma electrolytic oxidation chamber to produce the heater element of FIG. 2; and FIG. 4 shows the Voltage as function of time in the manufacturing of the heater element in the chamber of FIG. 3;

FIG. 5 shows a heater element according to the invention;

FIG. 6 A-B shows embodiments of a power/current increasing circuit;

Figure 1:
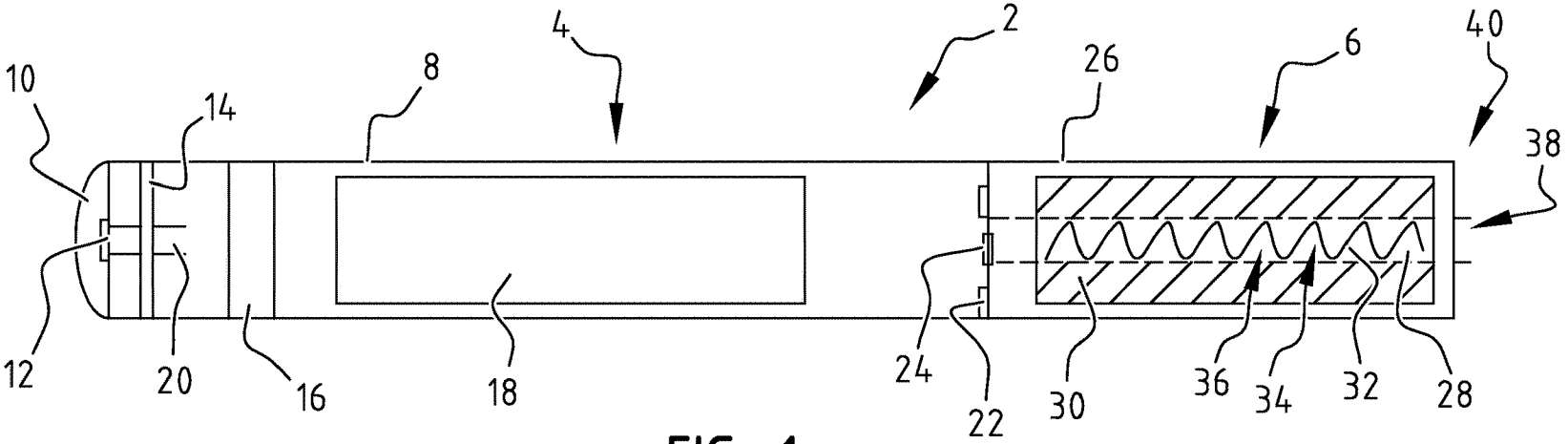

E-cigarette 2 (FIG. 1) comprises battery assembly 4 and atomizer assembly 6. In the illustrated embodiment atomizer assembly 6 is disposable. It will be understood that the invention can also be applied to systems with other configuration and that the illustrated embodiments is for exemplary purposes only. Details, including connections between components, that are known to the skilled person from conventional E-cigarettes have been omitted from the illustration to reduce the complexity of the drawing.

Battery assembly 4 comprises housing 8, (LED) indicator 10 with air inlet 12, air flow sensor 14, circuit 16 and battery 18. Air from inlet 12 is provided with air path 20 to sensor 14. Circuit 16 comprises an electronic circuit board that is connected to the relevant components of system 2. Battery 18 can be a rechargeable battery including the required connections to enable recharging. Battery assembly 4 has air inlet 22 and connector 24 to connect battery assembly to atomizer assembly 6.

Atomizer assembly 6 comprises housing 26 with air path 28 that is surrounded with buffer 30 comprising the E-liquid (for example a mixture of glycerol, propylene glycol, nicotine). Buffer material may include wicking material such as silica, cotton, etc.) or buffer 30 can be provided by other buffer means. In the illustrated embodiment heater element 32 is provided at or around the perimeter of air path 28. In one of the preferred embodiments heater element 32 comprises a wire of metallic titanium core 34 with ceramic titanium oxide layer 36 around metallic core 34. The E-liquid is absorbed and/or adsorbed in the porous ceramic layer. Wire 32 is heated by passing an electric current through metallic titanium core 34. Wire 32 is heated and the E-liquid is evaporated and/or atomized. The mixture is provided to outlet 38 of air path 28 at mouth piece 40.

Heater 32 achieves an improved temperature control and the ability to control the amount of E-liquid evaporating in time by varying the characteristics of the porous ceramic layer 36, such as thickness, size of pores, and porosity.

When inhaling at outlet 38 an under pressure in air paths 20, 28 is achieved. Air is sucked in through inlets 12, 22. Sensor 14 detects an air flow and circuit board 16 sends an indication signal to indicator 10. Battery 18 provides electricity to heater 32 that heats the E-liquid supplied from buffer 30 and vaporizes and/or atomizes the liquid such that a user may inhale the desired components therein.

In the illustrated embodiment heater 28 has its longitudinal axis substantially parallel to air path 28. It will be understood that other configurations are also possible according to the invention.

Optionally, heater 28 is surrounded by buffer 30. The surface area of buffer 30 is preferably provided with (small) openings that are filled with E-liquid from the buffer. Capillary action transfers liquid from the openings to heater element 30. The openings are preferably made in a metal tube-like surface of buffer 30 to prevent burning.

Figure 2A:
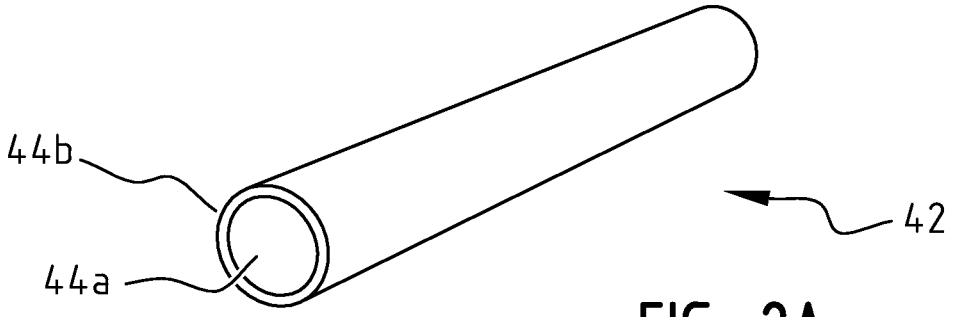
Figure 2B:
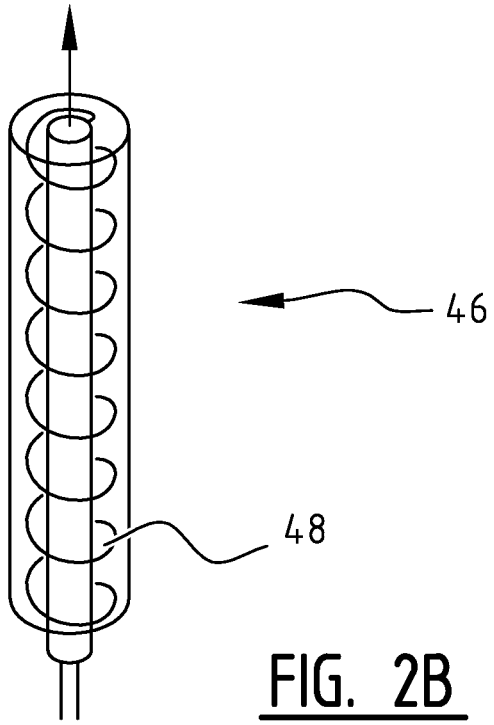
Figure 2C:
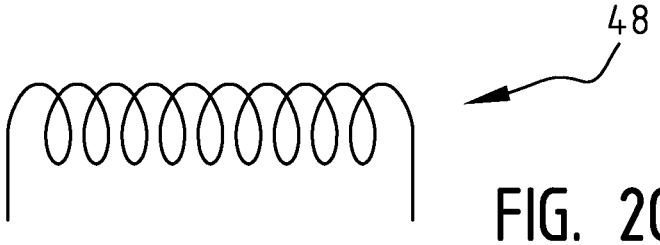
Figure 2D:
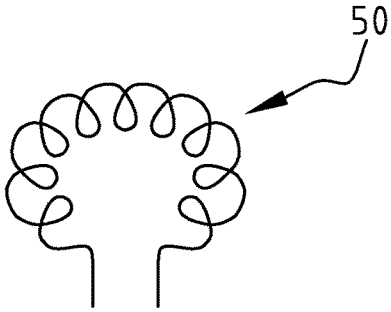
Figure 2E:
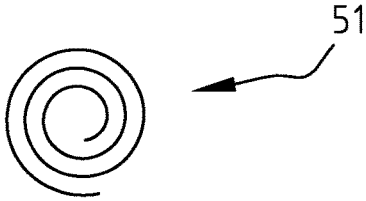
Figure 2F:
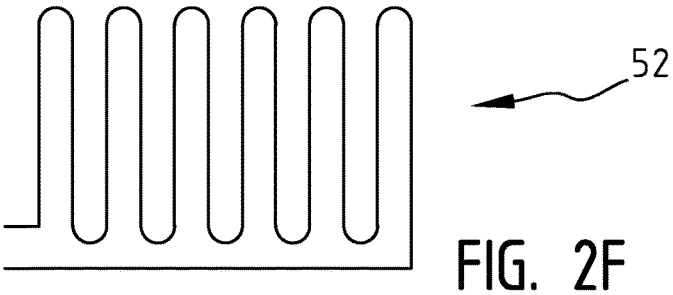

Several embodiments of a heater element according to the invention will be illustrated. Heater 42 (FIG. 2A) comprises a resistance heating material 44*a* as conductor and porous ceramic layer 44*b*. Heater 46 (FIG. 2B) is wound as a solenoid 48 (FIG. 2C) similar to heater 28 as illustrated in FIG. 1. In an alternative configuration heater 50 is configured as a toroid (FIG. 2D), or flat coil 51 (FIG. 2E), or flat spiral 52 (FIG. 2F), for example.

Figure 2G:
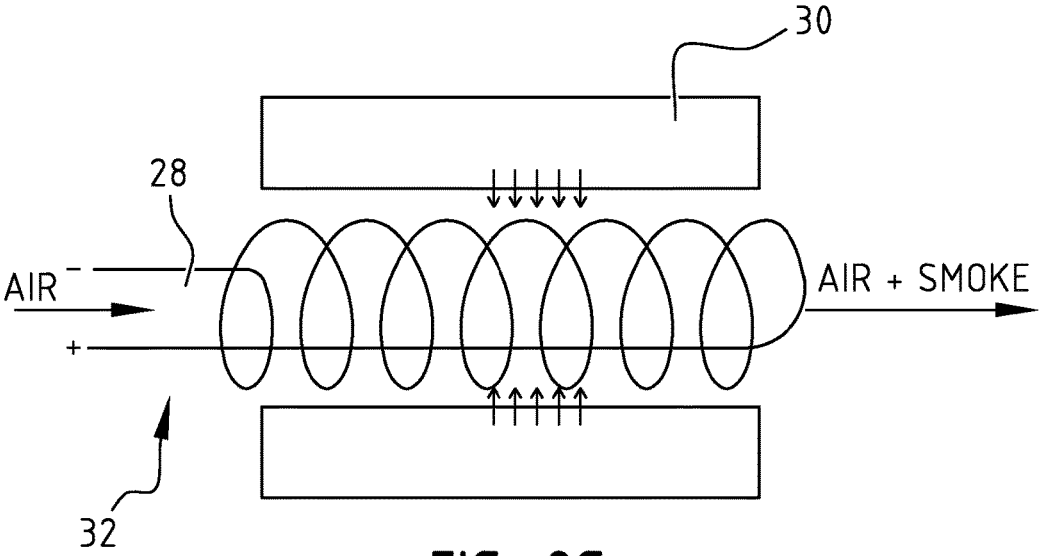
Figure 2H:
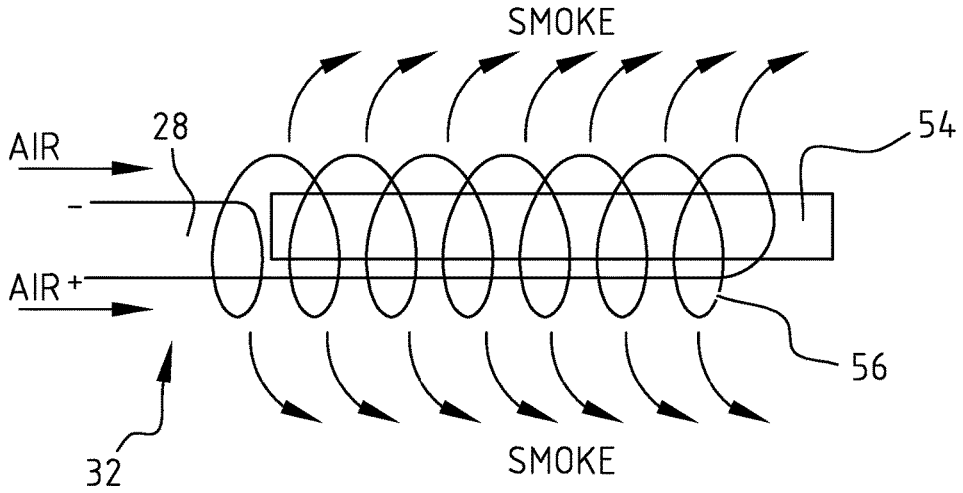

In the illustrated embodiment of system 2 buffer 30 is provided around air path 28 and heater 32 (see also FIG. 2G). In an alternative embodiment liquid reservoir 54 is provided inside the solenoid of heater 56 (FIG. 2H).

Figure 2I:
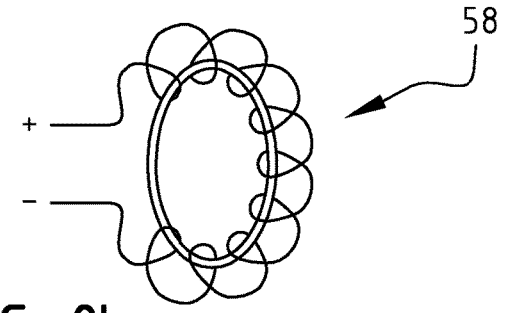
Figure 2J:
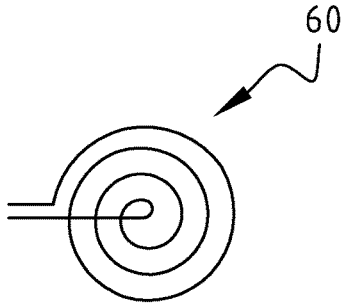
Figure 2K:
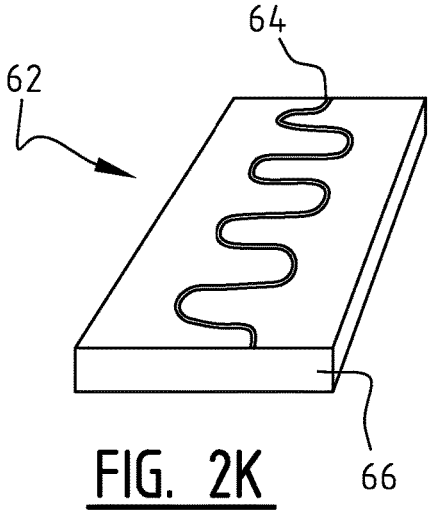
Figure 2L:
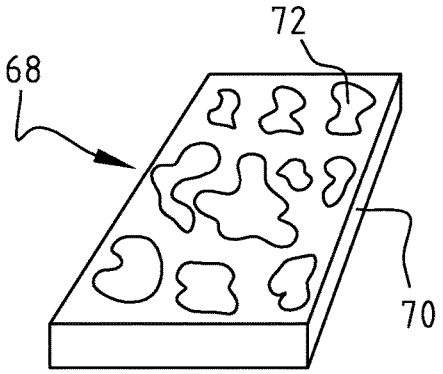
Figure 2M:
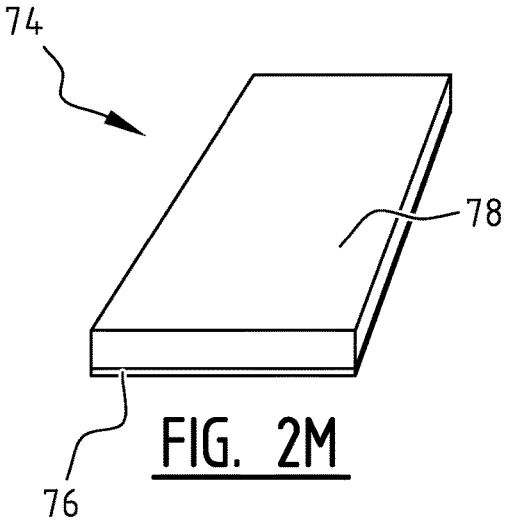
Figure 2N:
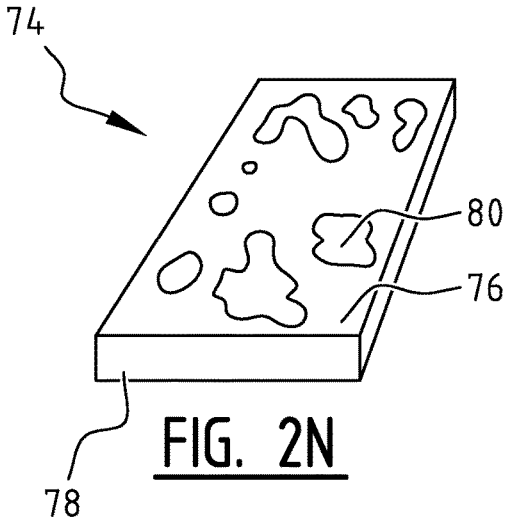
Figure 2O:
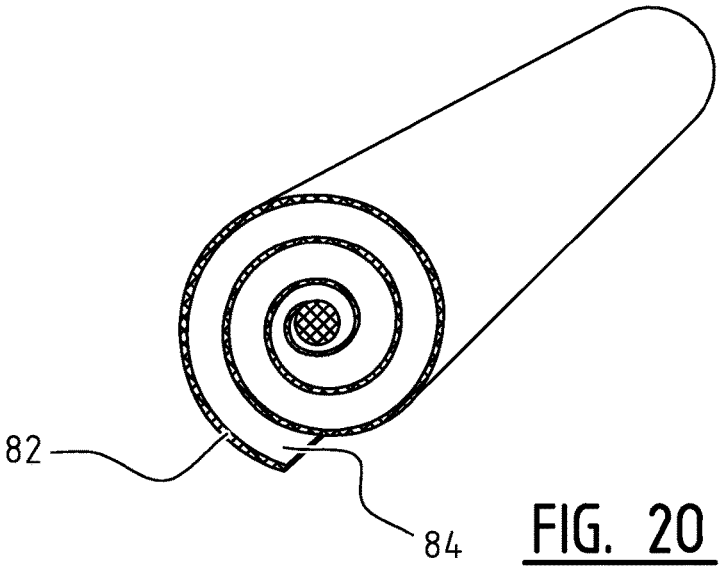

A further alternative configuration includes heater 58 (FIG. 2I) wound as toroid structure with liquid passing through the inside of the toroid structure and air flow passing around the toroid structure. Another alternative configuration includes heater 60 (FIG. 2J) formed as a flat coil. Also, heater 62 (FIG. 2K) may comprise a layer of path of resistance heating material 64 as conductor on coated porous ceramic layer 66, or alternatively heater 68 may comprise a conductor layer 70 with coated porous ceramic elements or spots 72 provided thereon (FIG. 2L). Alternatively, heater 74 comprises conductor layer 76 and ceramic layer 78 (FIG. 2M), and optionally additional ceramic spots 80 (FIG. 2N). Another embodiment comprises porous ceramic layer 82 with conductor 84 wound in a spiral configuration (FIG. 2O).

Figure 2P:
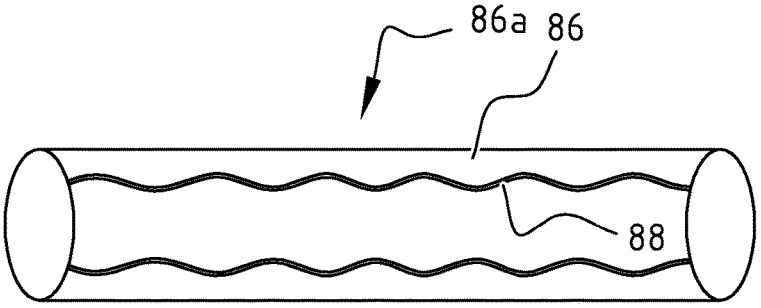
Figure 2Q:
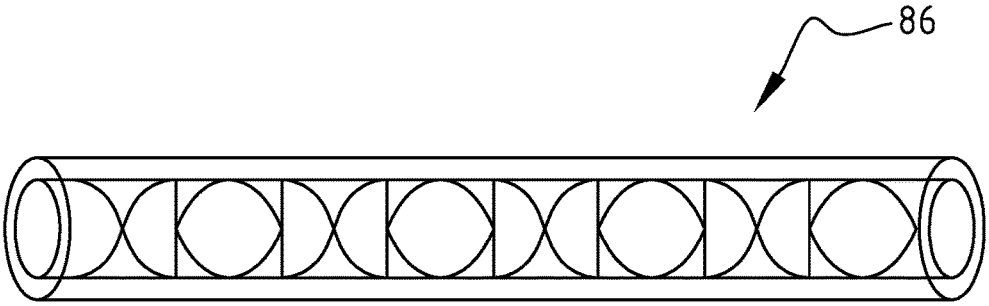
Figure 2R:
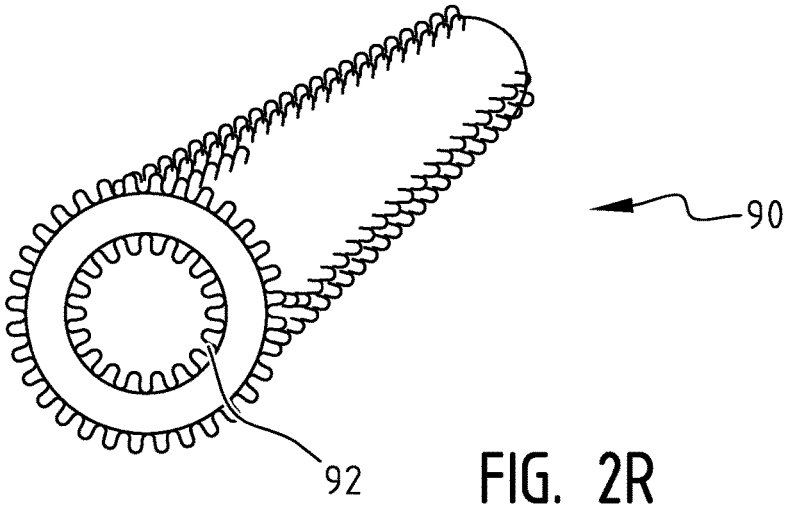
Figure 2S:
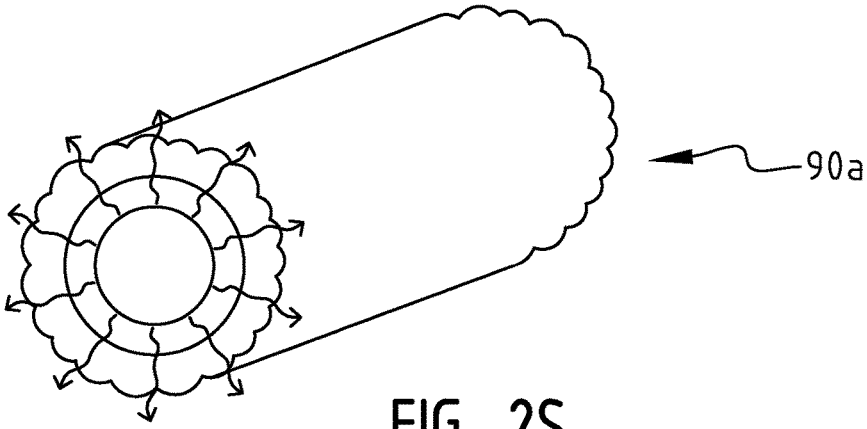
Figure 2T:
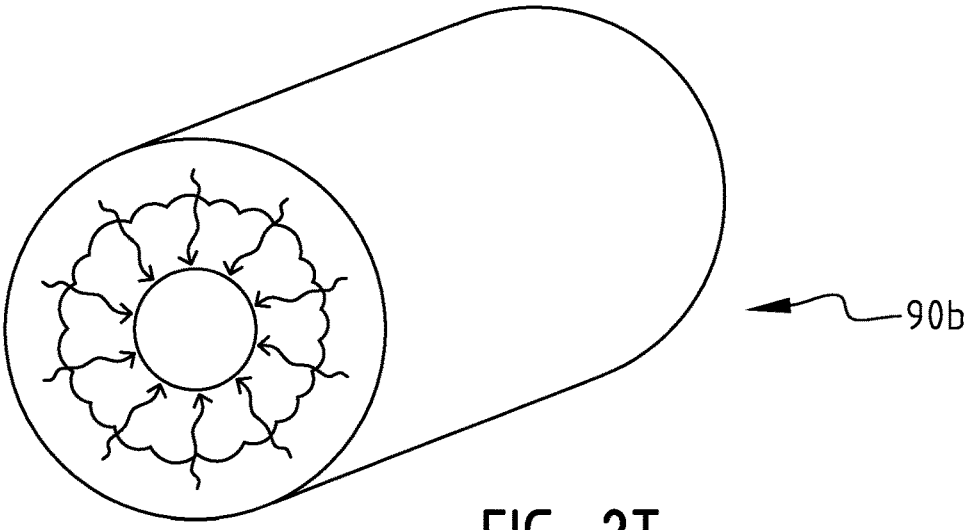
Figure 2U:
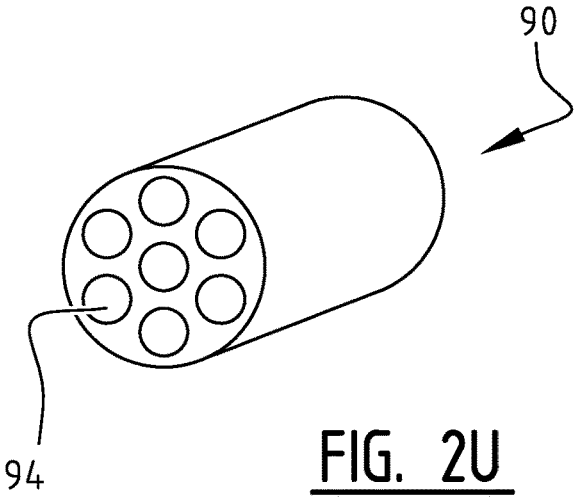
Figure 2V:
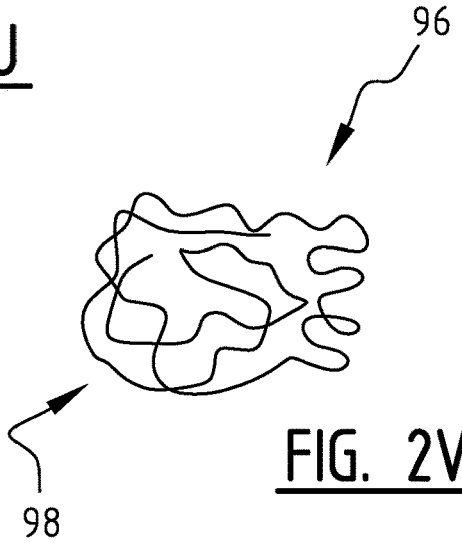

Other embodiments include conductor tube 86 with static mixing form 86*a* coated with ceramic layer 88 (FIGS. 2P and 2Q). As a further alternative, conductor 90 is a tube (FIG. 2R) with a ceramic layer 92. Tube 90*a* can be filled with liquid on the inside and having air flow on the outside (FIG. 2S) or tube 90*b* has air flow on the inside and liquid buffer on the outside (FIG. 2T). Optionally, a ceramic layer is provided on the inside and the outside of tube 90. Also, tube 90 may comprise a number of smaller tubes or wires 94 with resistance heating material and ceramic material (FIG. 2U). A further alternative configuration (FIG. 2V) involves resistance heating metallic foam or sponge 96 coated with porous ceramic material 98.

The disclosed embodiments for heater 32 provide examples of heaters according to the invention that can be applied to systems 2.

Heater elements according to the invention are preferably manufactured using plasma electrolytic oxidation. As an example, for illustrative reasons only, below some manufacturing methods for some of the possible configurations for the heater element according to the invention will be disclosed.

In a first embodiment of the heater element, plasma electrolytic oxidation of titanium wire that is directly connected to an anode is performed.

Figure 3A:
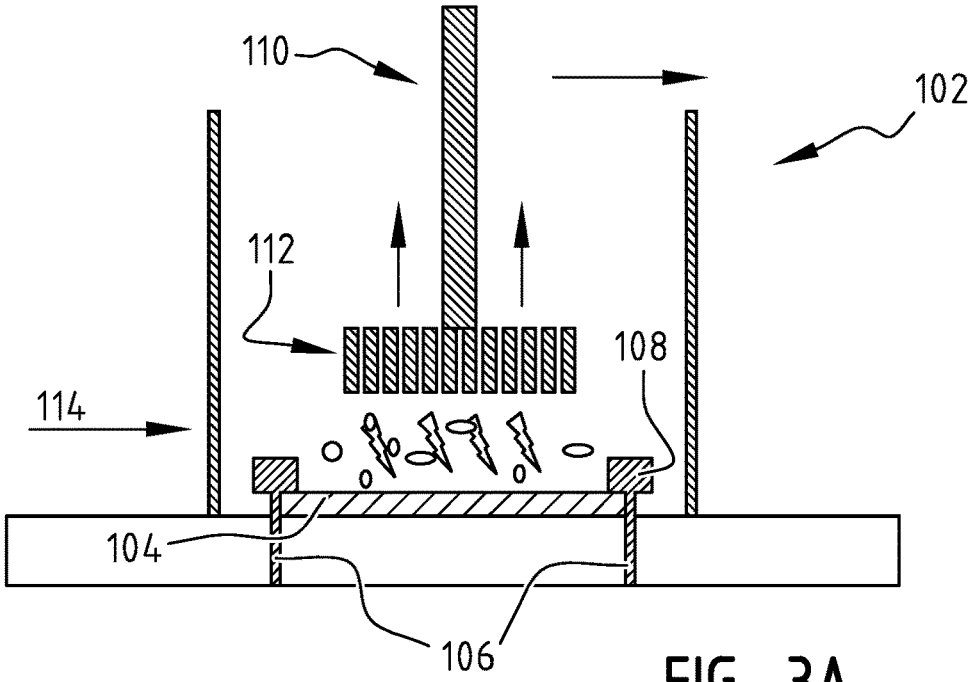

For the plasma electrolytic oxidation use is made of a plasma electrolytic chamber 102 (FIG. 3A). Work piece 104 is connected to the anode 106. Work piece 104 is clamped/fixed between two screws or clamps 108 that are connected to the ground/earth (anode 104) of a power supply. In the illustrated embodiment cathode 110 comprises stainless steel honeycomb electrode 112 that, in use, is placed at close distance above work piece 104. Electrolyte 114 flows between electrode 112 and anode 106, and effectively flows upwards through honeycomb electrode 112 together with the produced oxygen and hydrogen. Electrolyte effluent 116, together with the hydrogen and oxygen, is then cooled and optionally returned to chamber 102. In the illustrated embodiment the temperature of electrolyte 114 increases from around 11° C. entering plasma electrolytic oxidation chamber 102 to 25° C. exiting chamber 102 and is then cooled off using a heat exchanger (not shown).

In the illustrated chamber 102 two power supplies (Munk PSP family) are connected in series: one of 350 Volt and 40 Ampere and a second of 400 Volt and 7 Ampere resulting in a maximum of 750 Volt and 7 Ampere with resulting maximum power of 5.25 kW. The power supplies can be connected directly to anode 106 and cathode 110 resulting in direct current (DC) operation of the plasma. An optionally added switching circuit provides the option to operate the plasma with DC pulses. The frequency of the pulses can be set between DC and 1 kHz and different waveforms can be chosen (block, sine, or triangle). Plasma electrolytic oxidation is preferably performed in a pulsed current mode with a frequency (on-off) of about 1000 Hz, preferably with the current set at a fixed value and the voltage increases in time as a result of growing of the porous oxide layer. Current between 1 and 7 Ampere can be used to produce a ceramic layer.

Figure 3B:
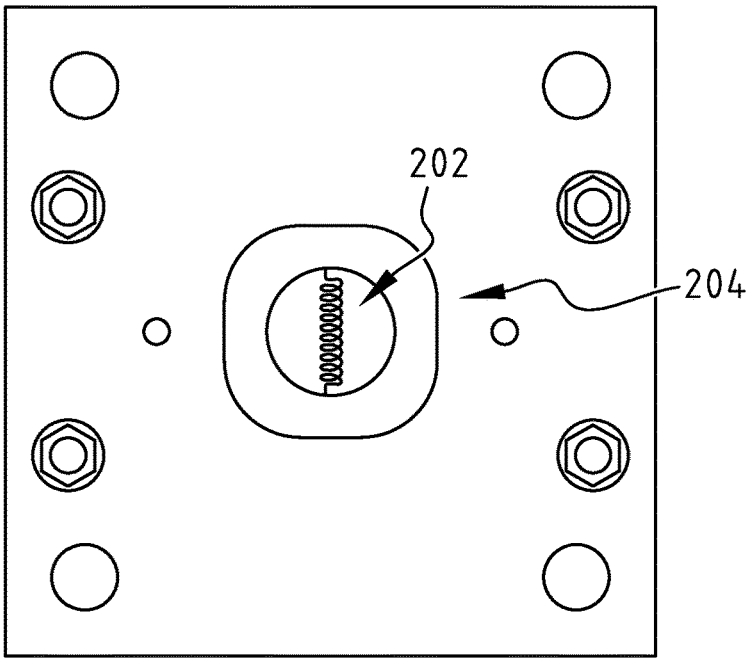
Figure 5:
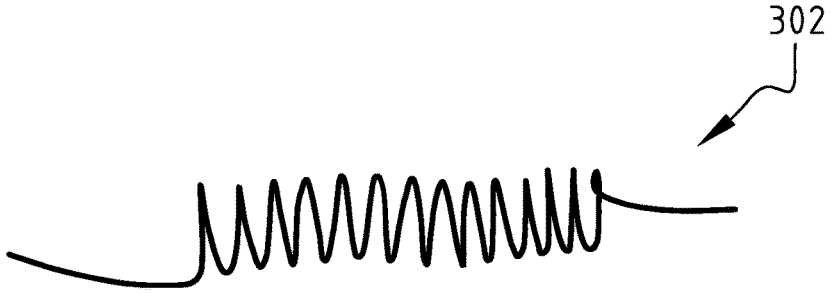

To produce a heater element according to the invention, in chamber 102 titanium wire 202 (FIG. 3B) is placed as work piece 104 on top of a titanium plate 204 that is connected to the stainless steel anode. Optionally, the anode is directly connected to wire 202. The electrolyte comprised 8 g/l $NaSiO3*5H_2O$ and 15 g/l $(NaPO3)_6$. Titanium wire is used made from titanium grade 1, with a diameter of 0.5 mm and 60 cm in length. The wire is coiled and connected to the anode. A potential higher than 500 volts is applied between the anode and cathode resulting in micro arc discharges on the surface of the titanium wire. On the surface of the wire, the metallic titanium is oxidized to titanium oxide with addition of silicates and phosphates from the electrolyte. The metallic layer is converted to a porous ceramic layer containing titanium oxides, phosphates and silicates. This results in a heater element 302 (FIG. 5) according to the invention.

Figure 6A:
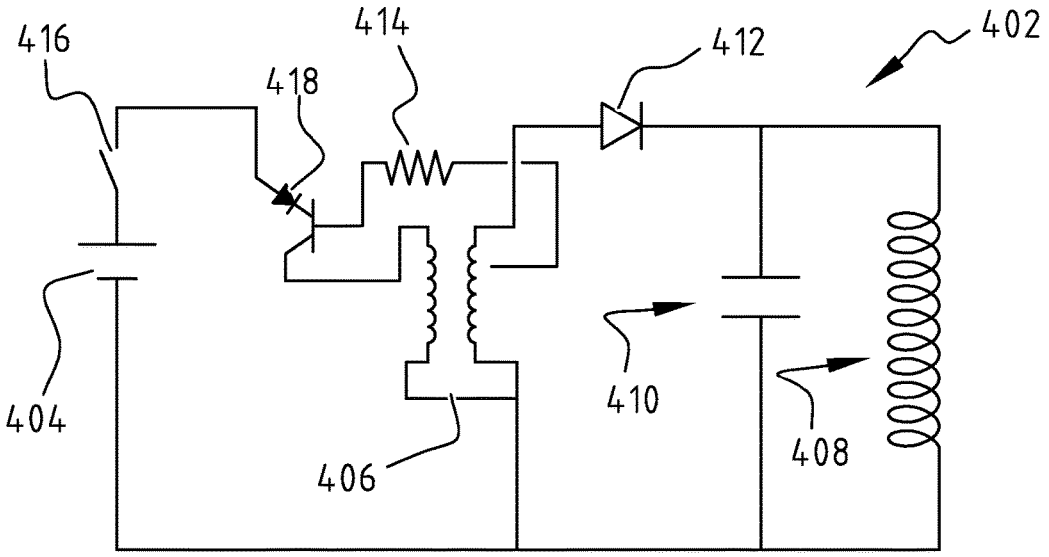
Figure 6B:
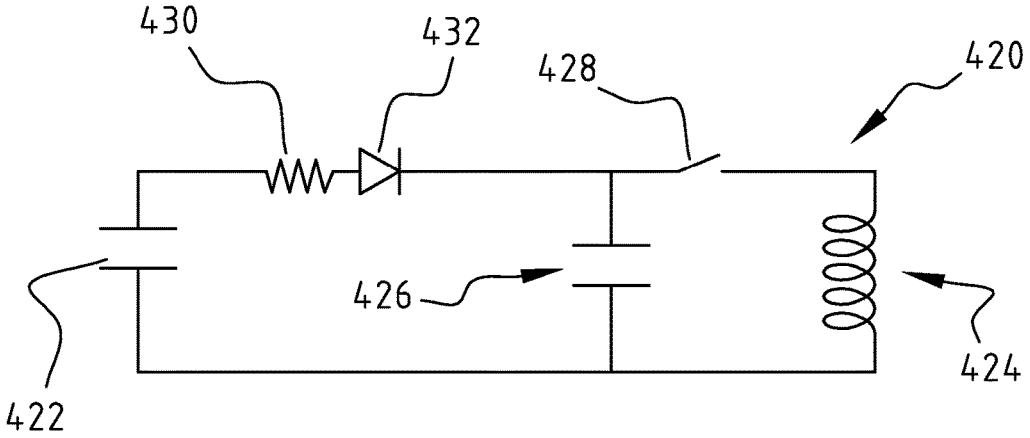

Current increasing circuit 402 (FIG. 6A) comprises battery 404, trafo 406, heater element 408 and (super) capacitor 410. Other components in circuit 402 include diode 412, resistance 414, switch 416 responding to inhaling, transistor 418. It will be understood that components in circuit 402 can be replaced with other components and/or additional components can be applied. For example, alternative circuit 420 (FIG. 6B) comprises battery 422, heater element 424, capacitor 426, switch 428, resistor 430 and diode 432.

When starting to inhale capacitor 410, 426 supplies additional current to heater element 408, 424 to accelerate the temperature increase of heater element 408, 424 and to start atomizing and/or vaporizing almost immediately. Preferably, the heater element is of a titanium material that exhibits a relatively low resistance at room temperature and a higher resistance at an increased temperature thereby enabling a fast response time to the activation signal.

In a presently preferred embodiment the conductor of the heater element is made of NiCr and preferably of Titanium. The resistance of Titanium (FIG. 7) increases more rapidly with temperature as compared to NiCr. This is illustrated with the linear relation for NiCr ($y=0.0011x+2.164$) as compared to the linear relation for Titanium ($y=0.0104x+1.5567$) defining the linear relation of the measured resistances at specific temperatures.

Figure 8:
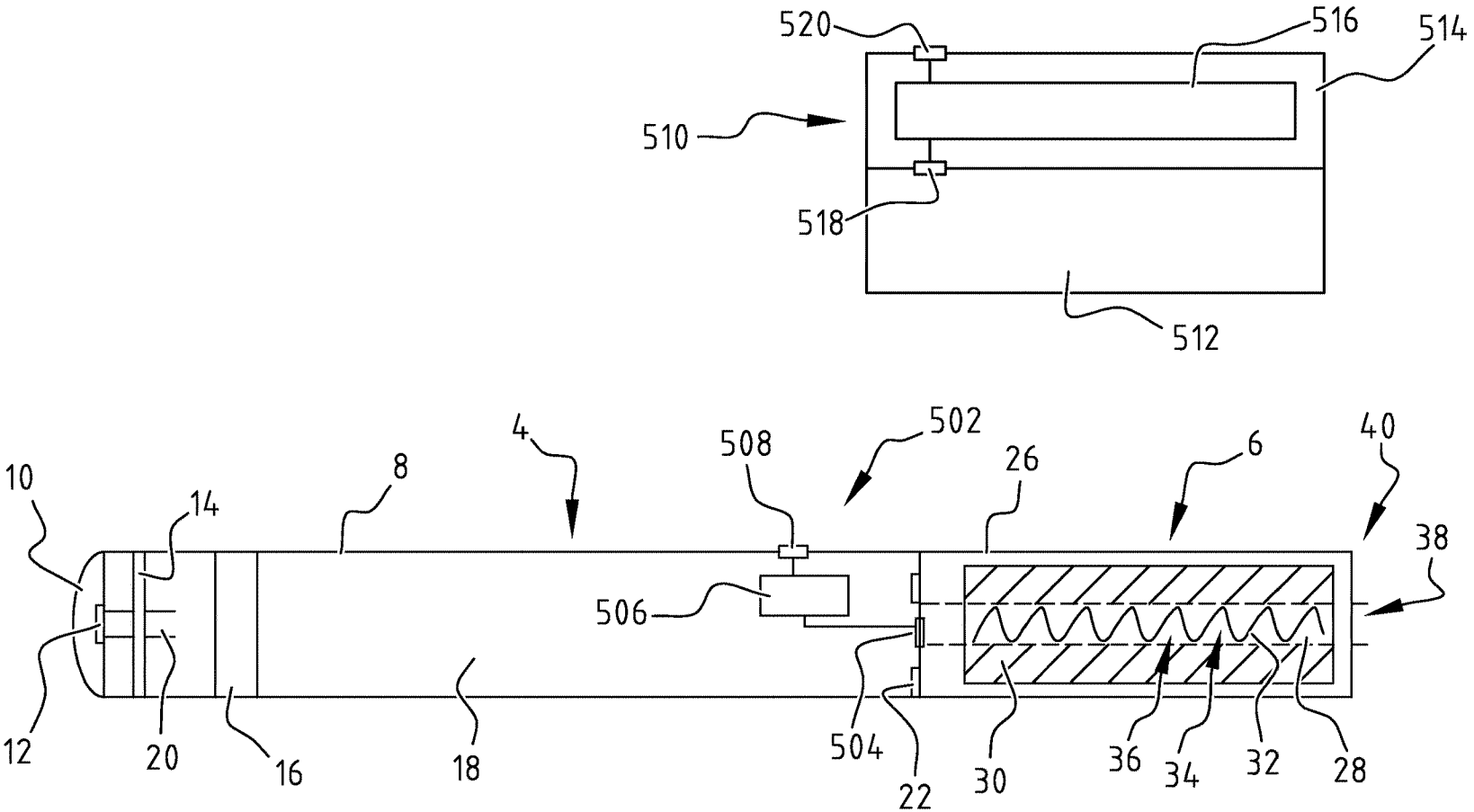
FIG. 8 shows an alternative embodiment of an E-cigarette according to the invention.

In a further embodiment of E-cigarette 502 (FIG. 8) heater 32 is supplied with energy through connector 504 from super capacitor 506. Capacitor 506 is charged via external connector 508. Capacitor 506 can be charged (semi)-directly and/or indirectly. Such indirect charging can be performed in connection with cigarette box 510 having cigarette storage compartment 512 and battery compartment 514 with battery 516. In a charging state charge connector 518 contacts connector 508 and super capacitor 506 is being charged. In the illustrated embodiment battery 516 is rechargeable through connector 520.

Figure 9:
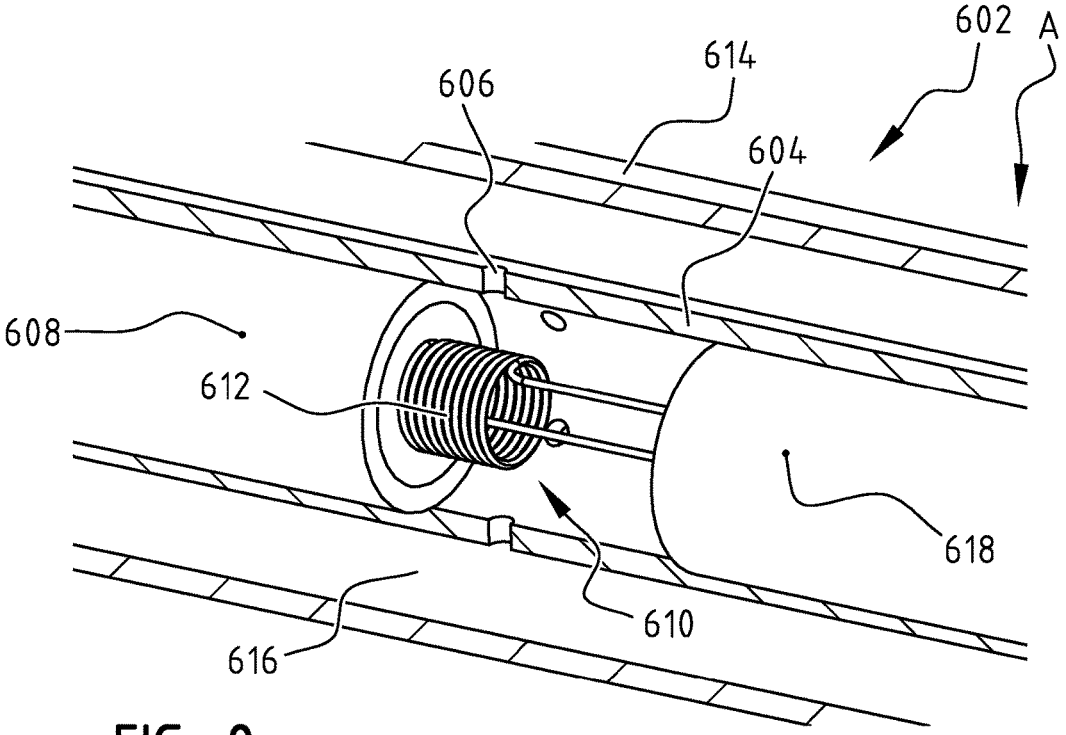
FIGS. 9-10 show a further preferred embodiment according to the invention.
Figure 10:
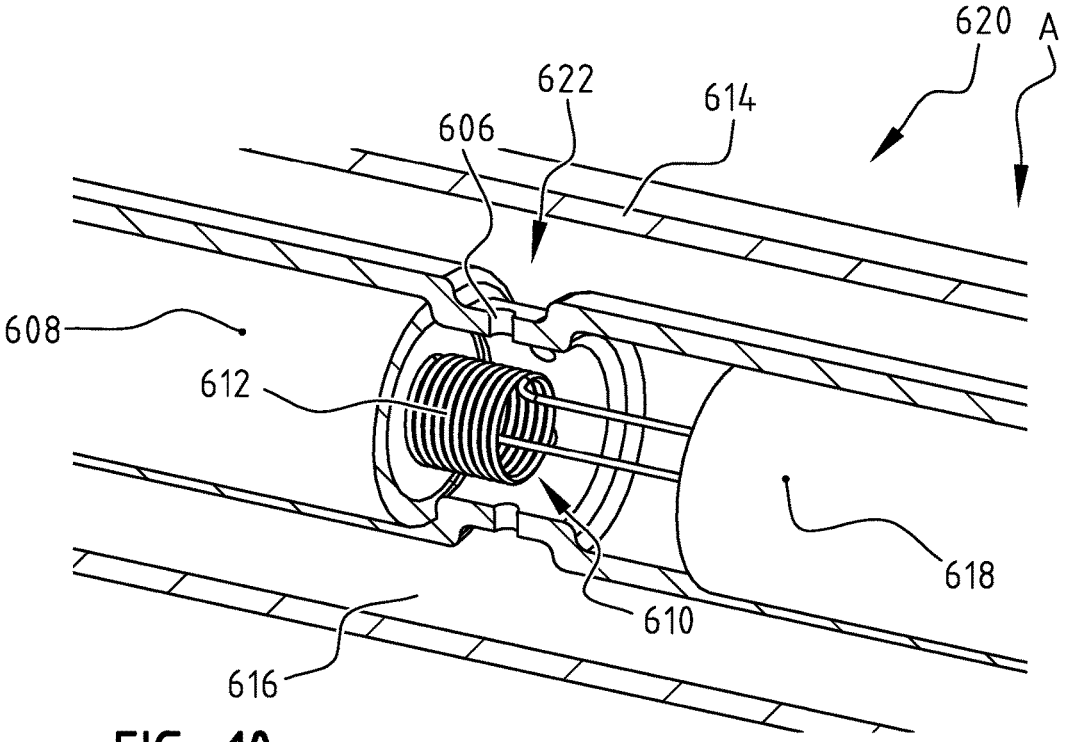

In aforementioned preferred embodiments of the system according to the invention, the electronic cigarette comprises two main parts, a first part with a battery with an airflow switch and electronic control equipment for the correct operation of an electronic cigarette, and a second part with a cartridge capable of containing the e-liquid, heating element and parts for the transportation of e-liquid onto the heating element. Cartridge 602 (FIG. 9-10) comprises metallic tube 604, in the illustrated embodiments of stainless steel, with eight holes 606 of about 0.25 mm diameter situated about 2.75 mm from the beginning A of the tube that in use is closest to the mouth piece of the electronic cigarette. In the illustrated embodiment tube 604 is about 29.1 mm in length with an outer diameter of about 4 mm and wall thickness of about 0.3 mm Ceramic tube 608, preferably of zirconium oxide, is provided inside metallic tube 604 at a position about 2.5 mm from openings with a length of about 22 mm, an outer diameter of about 3.4 mm and a wall thickness of about 0.35 mm.

Ceramic coated titanium heating element 610 is placed in the metallic tube 604 with holes 606. Heating element 610 is preferably made of a titanium wire (grade 1) coated with a ceramic layer and wound as a solenoid. The diameter of the titanium wire with the ceramic layer is about 0.25 mm, the total length of the wire used in the heating element is about 90 mm having about ten closely spaced windings 612 with a diameter of about 2.2 mm, and a total length of heating element 610 of about 1.4 mm. Heating element 610 is placed inside metallic tube 604 such that the first windings are positioned in ceramic tube 608 preventing heating element 610 to contact metallic tube 604.

Metallic tube 604 with holes 606 is pressed into a screw cap with connector(s) (not shown) and electrical insulator 618 on side A, and into an end cap (not shown) on the other side. Metallic housing 614, preferably a tube of stainless steel, extends between the screw cap and the end cap, with the tube having a length of about 3.8 mm, diameter of about 9.2 mm and wall thickness of about 0.2 mm. The space, room or compartment 616 between outer metallic tube 614 and inner metallic tube 604 with holes 606 can be filled with e-liquid. For example, the e-liquid comprises about 60% vegetable glycerin, about 30% propylene glycol and about 10% containing nicotine, flavoring and water. The ratio between nicotine, flavoring and water can be adjusted to the preferred amount.

The screw cap of cartridge 602 is connected to the battery of the electronic cigarette thereby connecting the positive and negative poles of the battery to the positive and negative connector of heating element 610. This enables an electric current to flow from the positive pole to the negative pole through the titanium wire to increase the temperature of the titanium wire by joule heating. The electric current is controlled by the flow switch that is activated by the user. In use, air flows through metallic tube 604 with holes 606 and e-liquid is transported towards heating element 610. By increasing the temperature of heating element 610, e-liquid evaporates in the air flow and the evaporated e-liquid is transported to the user.

In an alternative embodiment cartridge 620 (FIG. 10) is provided with similar components with the exception that holes 606 are provided in groove 622.

It will be understood that components of cartridges 602, 620 can be combined in further embodiments. Cartridges 602, 620 and alternative embodiments can be used in electronic cigarettes 2, 502 and other embodiments thereof.

Figure 11:
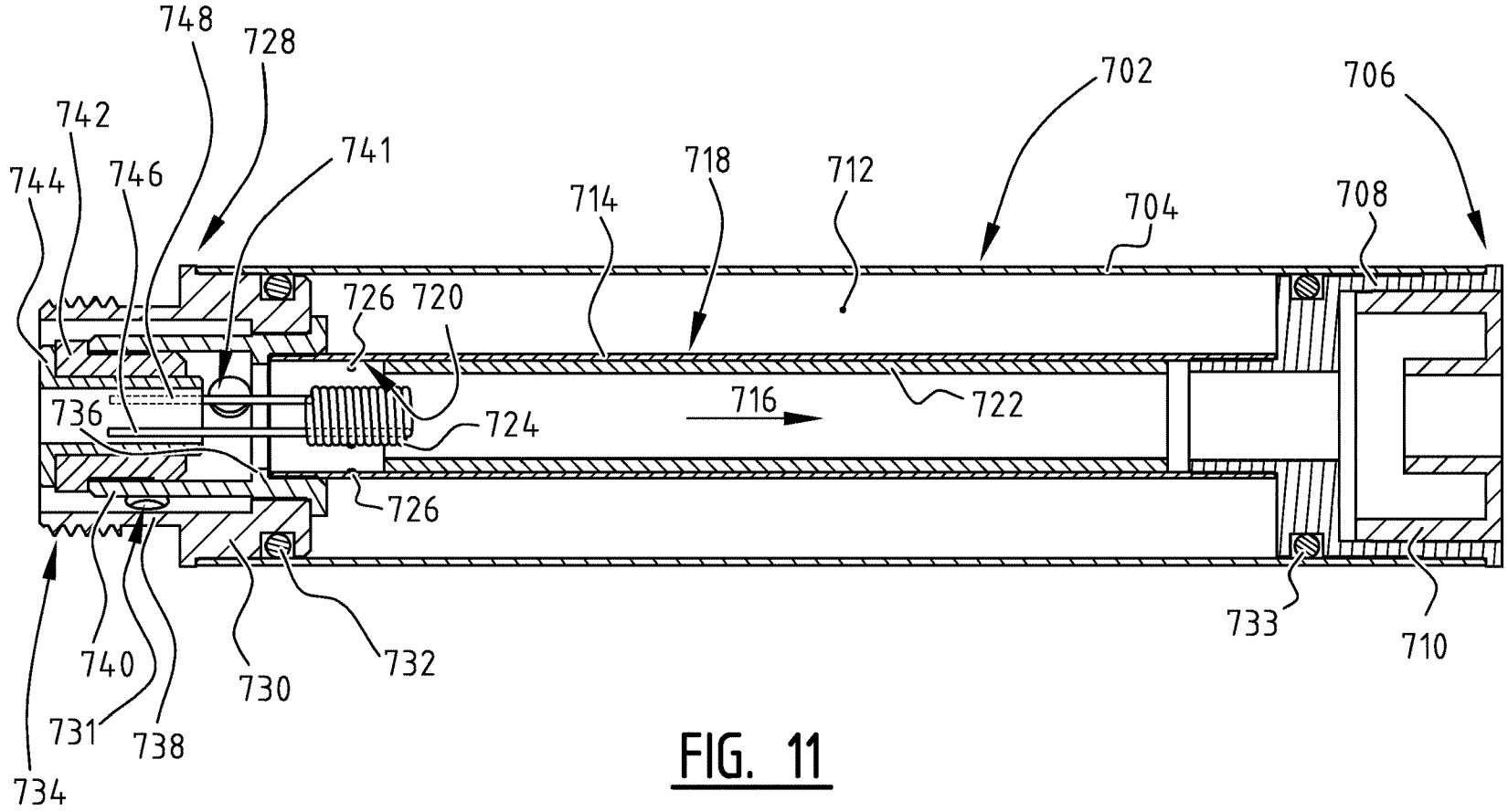
FIG. 11 shows a further preferred embodiment of an atomizer assembly according to the invention.

Atomizer assembly 702 (FIG. 11) comprises housing 704. At end 706 housing 704 is provided with end ring 708 that is preferably pressed in housing 704, and seal 733. End cap 710 is pressed in ring 708. Housing 704 comprises buffer or reservoir 712 and metal tube 714. Flow path 716 extends through tube 714. Reservoir 712 is positioned around outer surface 718 of tube 714. In the illustrated embodiment inner surface 720 of tube 714 is provided with ceramic layer 722. Tube 714 further comprises heater element 724. Openings 726 in tube 714 enable transport of fluid from reservoir 712 towards heater element 724. In the illustrated embodiment tube 714 has eight openings 726 with a diameter of about 0.2 mm. It will be understood that other dimensions and shapes can also be envisaged in accordance with the present invention. At end 728 housing 704 is provided with connector 730. Connector 730 with opening(s) 731 comprises seal 732 and screw thread 734. Edge or stop 736 of connector 730 is used for positioning tube 714. In addition, stop 736 prevents leakage of liquid from reservoir 712. In the illustrated embodiment connector 730 is manufactured from brass material. Optionally, connector 730 comprises (separate) connector part 738 having screw thread 734. Assembly 702 further comprises ring 740 with opening(s) 741. Rubber ring 742 separates connector 730 from metal pin 744. First leg 746 of heater element 724 is connected to pin 744. Second leg 748 of heater element 724 is connected to connector 730 and/or ring 740 thereof.

It will be understood that other configurations of the legs and/or other components can be envisaged in accordance with the present invention, including combining different elements in a single part and/or separating a part into several sub-parts.

Figure 4:
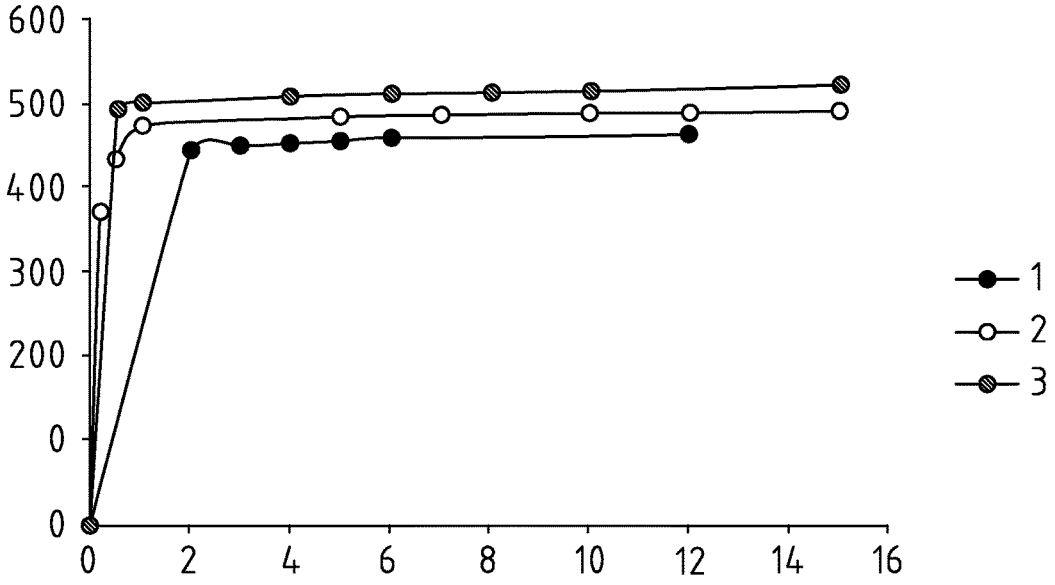

Three experiments were done: 1) 0.5 Ampere for 15 minutes, 2) 1 Ampere for 15 minutes and 3) 2 Ampere for 15 minutes. The mass and diameter of the wire was measured before and after plasma electrolytic oxidation. The wire was placed in water for 5 minutes and the mass was measured as an indication of the amount of water adsorbed on the wire. The voltage as a function of time of the three different current settings can be seen in FIG. 4, and some further material information before and after oxidation is presented in Table 1.

TABLE 1

Material information

| | Weight (mg) 1 | 2 | 3 |
|---|---|---|---|
| Before PEO (mg) | | 525.49 | 529.82 |
| After PEO (mg) | 528.37 | 539.42 | 548.71 |
| After heating (mg) | 528.09 | 539.23 | 547.67 |
| After 5 min in water (mg) | 675.7 | 692.23 | 705.42 |
| Thickness (μm) | 36 | 71 | 113 |
| Volume geads (ml) | 0.15 | 0.15 | 0.16 |
| Volume oxide layer (ml) | 0.45 | 0.51 | 0.59 |
| Porosity (%) | 32.71 | 29.87 | 26.73 |

Ceramic wires were manufactured at different process conditions, including with 5 Ampere (wire 1) and 1 Ampere (wire 2) for processing time of an hour. The results are shown in Table 2.

TABLE 2

Thickness of ceramic layer porosity and adsorption of two ceramic titanium wires

| | Time + current | Ceramic thickness | Porosity | Adsorption | Resistance |
|---|---|---|---|---|---|
| Wire 1 | 1 hr @ 5 A | 55 μm | 45% | 21 μl | 1.4Ω |
| Wire 2 | 1 hr @ 1 A | 30 μm | 50% | 13 μl | 1.3Ω |

Wire 1: Before plasma electrolytic oxidation (PEO)

L=0.5 m, D=0.500 mm, R=1.2Ω, $R_{calculated}$=2.44 Ω/m, Adsorption (water)=4 μl

Wire 1: After PEO (5 A for 60 minutes)

L=0.5 m, D=0.610 mm, R=1.3-1.4Ω, Adsorption (water)=21 μl, Porosity=44%

Wire 2: Before PEO:

L=0.5 m, D=0.500 mm, V=9.8 e−8 $m^3$, m=4.2992 e−4 kg, ρ=4379 kg/$m^3$

Wire 2: After PEO (1 A for 60 minutes)

L=0.5 m, D=0.5610 mm, V=1.236 e−8 $m^3$, m=4.512 e−4 kg, ρ=3650 kg/$m^3$, $m_{oxide\ layer}$=2.13 e−5 kg, $V_{oxide\ layer}$=2.56 e−8 $m^3$, $M_{estimate\ without\ porosity}$=4.452 e−5 kg, Porosity=50%, Calculated adsorption=12.8 μl It will be understood that for alternative wires other conditions would apply. For example, for a wire having a diameter of 0.1 mm $R_{calculated}$=61 Ω/m. Such wire with a length of 6.5 cm will give a resistance of 4Ω. With an oxide thickness of 100 μm an amount of 1.3 μl is adsorbed. 150 μm gives 3.1 μl and 200 μm gives 5.4 μl.

The experiments illustrate the manufacturing possibilities of the heater element for the system according to the present invention. Further experiments have been conducted to produce other configurations for the heater. In one such further experiment a metal foil, preferably an aluminium foil, was used as starting material on which a porous metal (aluminium) oxide layer is provided, preferably in a plasma electrolytic chamber that is described earlier. Table 3 shows measured values of plasma electrolytic oxidation with constant current at 5 ampere for 9 minutes. Aluminium foil of 13 μm thickness was oxidized with a resulting thickness of aluminium oxide of 13 μm and Table 4 shows the reproducibility of the process. Both tables show voltage, current, temperature of electrolyte going in the plasma electrolytic oxidation chamber (Tin) and going out the plasma electrolytic oxidation chamber (Teff) for constant current of 5 A.

TABLE 3

| t min. | Voltage V | Current A | Tin ° C | Teff ° C. |
|---|---|---|---|---|
| 0.167 | 434 | 5 | | |
| 0.5 | 447 | 5 | | |
| 1 | 461 | 5 | | |
| 2 | 476 | 5 | 10.1 | 18.8 |
| 4 | 487 | 5 | 10.9 | 20.4 |
| 6 | 499 | 5 | 11.3 | 21.4 |
| 9 | 515 | 5 | | |

TABLE 4

| t min. | Voltage V | Current A | Tin ° C. | Teff ° C. |
|---|---|---|---|---|
| 0.167 | 435 | 5 | | |
| 0.5 | 448 | 5 | | |
| 1 | 460 | 5 | | |
| 2 | 474 | 5 | 11.3 | 19.7 |
| 4 | 488 | 5 | | |
| 6 | 495 | 5 | | |
| 8 | 505 | 5 | | |

Table 5 shows the voltage and current for plasma electrolytic oxidation of aluminium foil at constant current of 2 A. Result was a 13 μm thick aluminium oxide layer.

TABLE 5

Voltage and current of plasma electrolytic oxidation with constant current of 2 A.

| t min. | Voltage V | Current A |
|---|---|---|
| 1 | 380 | 2 |
| 2 | 415 | 2 |
| 3 | 429 | 2 |
| 4 | 437 | 2 |
| 5 | 443 | 2 |
| 6 | 448 | 2 |
| 7 | 452 | 2 |

Table 6 shows the voltage and current of the plasma electrolytic oxidation of aluminium foil with pulsed constant current of 1 kHz at 5 Ampere.

TABLE 6

Voltage and current of pulsed constant current of 1 kHz

| T min. | Voltage V | Current A |
|---|---|---|
| 0.167 | 470 | 5 |
| 0.5 | 485 | 5 |
| 1 | 491 | 5 |
| 2 | 502 | 5 |
| 4 | 514 | 5 |
| 6 | 523 | 5 |

In a further experiment, plasma electrolytic oxidation was used to provide a porous, flexible and elastic ceramic layer of >70 μm on titanium foil. Plasma electrolytic oxidation grows a titanium oxide layer which is known to be ceramic ($TiO_2$). Electrolyte was used with 8 g/l $Na_2SiO_3*5H_2O$ (Natrium metasilicate pentahydrate) and 15 g/l $(NaPO_3)_6$ (Natrium hexametaphosphate). The electrolyte is pumped into the reaction chamber to act as the electrolyte and as a coolant. Titanium foil was used from titanium grade 2 with a thickness of 124 μm. In the manufacturing process the voltage increases as a function of time. This increase signifies an increased resistance and can possibly be explained by the growth of the titanium oxide (TiOx) layer. A thicker TiOx layer acts like an insulating layer between the metal and electrolyte. The resulting Voltage development in time can be seen in Table 7.

TABLE 7

Voltage and current as function of time for production of ceramic layer on titanium foil with plasma electrolytic oxidation

| Time min. | Voltage V | Current A |
|---|---|---|
| 0.166667 | 435 | 6 |
| 0.5 | 510 | 6 |
| 1 | 540 | 6 |
| 2 | 551 | 6 |
| 3 | 553 | 6 |
| 4 | 554 | 6 |
| 5 | 556 | 6 |
| 6 | 556 | 6 |
| 7 | 557 | 6 |
| 10 | 557 | 6 |

The resulting foil structure can be processed further involving electrochemical machining. For example, use can be made of dissolution of Titanium grade 2 to make perfect squared shaped channels. With electrochemical machining (ECM) Titanium grade 2 is locally dissolved in a very controlled manner until the ceramic layer is reached. The finished result has to be well defined channels with squared edges and no residue on top of the ceramic layer. The ECM process is used with a cathode with the inverse shape of the product placed on top of a Titanium plate that serves as the anode. A potential is placed between the cathode and anode causing the anode to dissolve. Electrolyte concentration is 5 M $NaNO_3$. Current density can be varied from 20-150 $A/cm^2$. The best results were realized with current densities of >60 $A/cm^2$. Current is operated in a pulsed mode with the time the current is on and off can be varied. Best results were realized with on/off ratio of 16-80 and pulse on from 0.05 until 10 ms and pulse off from 1 ms until 160 ms. This additional processing step may also be applied to other configurations for the heater.

Figure 7:
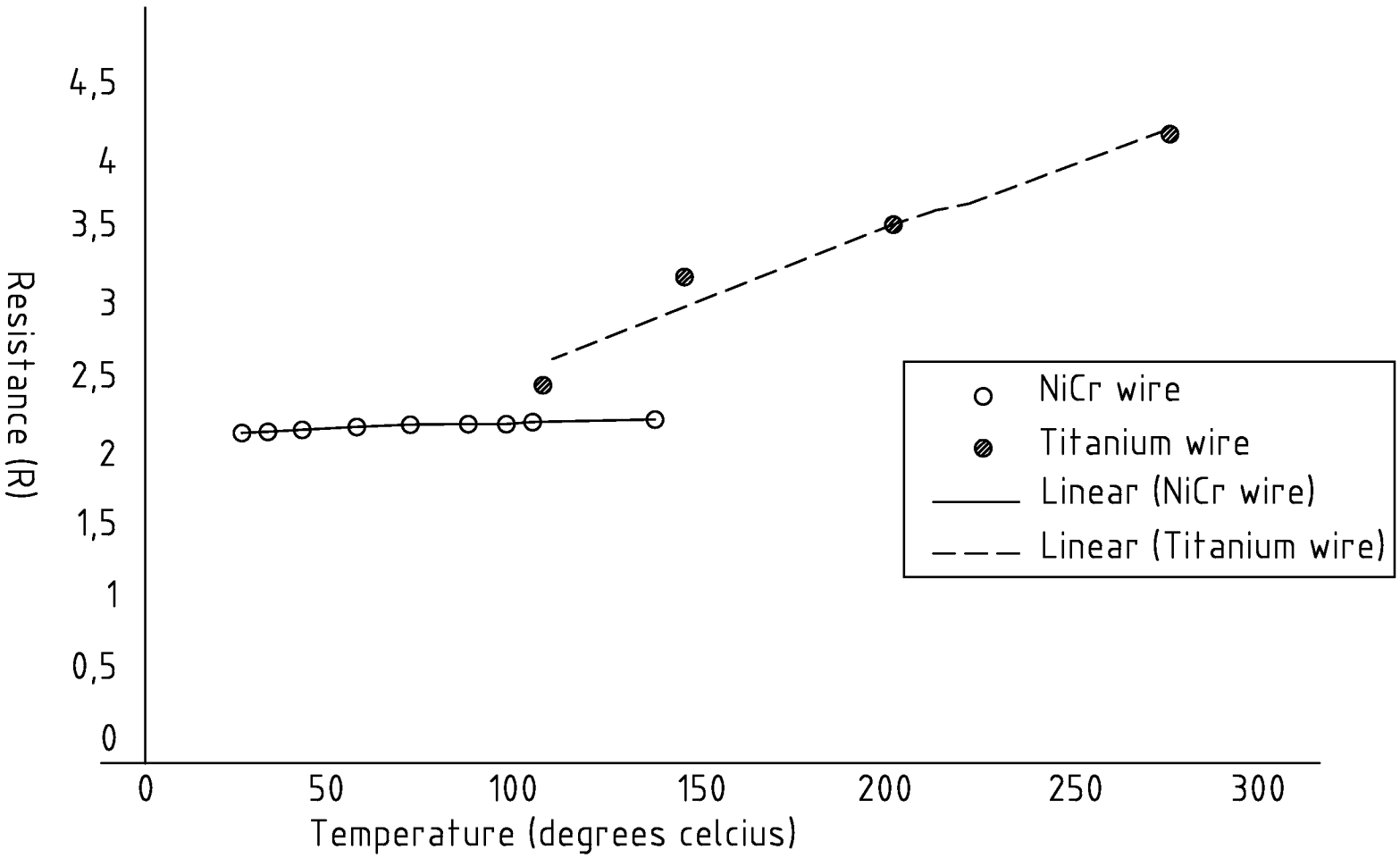
FIG. 7 shows the resistance of electric heater elements in relation to temperature for titanium and NiCr.

In a presently preferred embodiment the heater element is made from a titanium wire, or less preferably from NiCr wire. FIG. 7 shows the resistance of electric heater elements in relation to temperature for both materials. As mentioned earlier the use of titanium for the heater element is beneficial.

The above described experiments illustrate the possibility to manufacture the different configurations of the heater element and to implement such configuration in an E-cigarette, for example. The present invention is by no means limited to the above described preferred embodiments thereof. The rights sought are defined by the following claims, wherein the scope of which many modifications can be envisaged.

The invention claimed is:

1. A personal electronic delivery system, comprising:

a housing having a first end with an inlet and a second end with an outlet;

a fluid path substantially extending between the inlet and the outlet;

a buffer for holding a delivery fluid, and connecting means configured to transfer delivery fluid to the fluid path; and a heater that is provided in, at or close to the fluid path configured for heating the delivery fluid such that at least a part of the delivery fluid atomises and/or vaporises in the fluid path, and an energy source configured for providing energy to the heater, wherein the heater comprises a metal conductor that is provided with a porous ceramic layer that is configured to control the atomizing and/or vaporization, and wherein the buffer substantially surrounds the heater, wherein the buffer is provided with openings configured for transferring delivery fluid to the heater, wherein the openings are configured to enable a venturi effect transferring delivery fluid to the heater, and wherein the openings are provided in a groove.

2. A personal electronic delivery system, comprising:

a housing having a first end with an inlet and a second end with an outlet;

a fluid path substantially extending between the inlet and the outlet;

a buffer for holding a delivery fluid, and connecting means configured to transfer delivery fluid to the fluid path; and a heater that is provided in, at or close to the fluid path configured for heating the delivery fluid such that at least a part of the delivery fluid atomises and/or vaporises in the fluid path, and an energy source configured for providing energy to the heater, wherein the heater comprises a metal conductor that is provided with a porous ceramic layer that is configured to control the atomizing and/or vaporization, and wherein the buffer substantially surrounds the heater, wherein the buffer is provided with openings configured for transferring delivery fluid to the heater, wherein the ceramic layer is deposited on or at the conductor with plasma electrolytic oxidation, wherein the ceramic layer is provided with a porosity such that the delivery fluid is transferred from the buffer to the vicinity of the conductor by the ceramic layer, wherein the openings are provided adjacent the heater, and wherein the openings are provided in a groove.

3. A personal electronic delivery system, comprising:

a housing having a first end with an inlet and a second end with an outlet;

a fluid path substantially extending between the inlet and the outlet;

a buffer for holding a delivery fluid, and connecting means configured to transfer delivery fluid to the fluid path; and a heater that is provided in, at or close to the fluid path configured for heating the delivery fluid such that at least a part of the delivery fluid atomises and/or vaporises in the fluid path, and an energy source configured for providing energy to the heater, wherein the heater comprises a metal conductor that is provided with a porous ceramic layer that is configured to control the atomizing and/or vaporization, and wherein the buffer substantially surrounds the heater, wherein the buffer is provided with openings configured for transferring delivery fluid to the heater, wherein the openings are provided adjacent the heater, and wherein the openings are provided in a groove.

* * * * *